US005773761A

United States Patent [19]

Hartikainen et al.

[11] Patent Number: 5,773,761

[45] Date of Patent: Jun. 30, 1998

[54] METHOD FOR PRODUCING AN ELECTRIC CABLE AND AN ELECTRIC CABLE

[75] Inventors: Jukka Hartikainen; Eero Kaakko, both of Kirkkonummi; Pertti Korhonen, Espoo; Torsten Hagelberg, Pikkala; Pekka Luoma, Kirkkonummi; Hannu Mäkinen, Espoo; Seppo Saarinen, Siuntio; Eero Tanner, Masala, all of Finland

[73] Assignee: Nokia Kaapeli OY, Helsinki, Finland

[21] Appl. No.: 532,711

[22] PCT Filed: Apr. 13, 1994

[86] PCT No.: PCT/FI94/00139

§ 371 Date: Nov. 29, 1995

§ 102(e) Date: Nov. 29, 1995

[87] PCT Pub. No.: WO94/24679

PCT Pub. Date: Oct. 27, 1994

[30] Foreign Application Priority Data

Apr. 14, 1993 [FI] Finland ..... 931671

[51] Int. Cl.[6] ..... H01B 7/32

[52] U.S. Cl. ..... 174/113 R; 29/854

[58] Field of Search ..... 174/113 R, 108, 174/36; 29/854

[56] References Cited

U.S. PATENT DOCUMENTS

| | | | |
|---|---|---|---|
| 3,231,665 | 1/1966 | Grimes, Jr. et al. | 174/108 |
| 3,484,532 | 12/1969 | Anderson | 174/108 |
| 4,360,704 | 11/1982 | Madry | 174/36 |
| 4,484,586 | 11/1984 | McMickle et al. | 174/108 |
| 4,727,222 | 2/1988 | Sato | 174/108 |
| 4,803,309 | 2/1989 | Marin et al. | 174/108 |
| 4,894,488 | 1/1990 | Gupta | 174/28 |

FOREIGN PATENT DOCUMENTS

| | | |
|---|---|---|
| 0234521 | 9/1987 | European Pat. Off. . |
| 911600 | 9/1993 | Finland . |
| 3346169 | 12/1983 | Germany . |
| 1238107 | 7/1971 | United Kingdom . |

*Primary Examiner*—Kristine L. Kincaid
*Assistant Examiner*—Marc D. Machtinger
*Attorney, Agent, or Firm*—Ladas & Parry

[57] ABSTRACT

A method of producing an electric cable and an electric cable. In the electric cable, a short-circuiting layer is provided between an insulated conductor/insulated conductors (4*a*) and a protective covering (7) surrounding the conductor/s, the short-circuiting layer being formed by short-circuiting wires (3) extending substantially parallel with the conductor/s, and a contact member (6) positioned substantially transversely to the short-circuiting wires and connecting the wires electrically. To speed up the production process, the contact member (6) is formed of a bundle of wires.

9 Claims, 1 Drawing Sheet

METHOD FOR PRODUCING AN ELECTRIC CABLE AND AN ELECTRIC CABLE

FIELD OF THE INVENTION

The invention relates to a method for producing an electric cable, wherein a short-circuiting layer is provided between an insulated conductor/insulated conductors and a protective covering surrounding the conductor/conductors, the short-circuiting layer comprising short-circuiting wires extending substantially parallel with the conductor/s, and a contact member positioned substantially transversely with respect to the short-circuiting wires and connecting the wires electrically. The invention also relates to an electric cable.

BACKGROUND AND PRIOR ART

Power cables are provided at the production stage with a special short-circuiting layer between the insulated cable conductors and the protective outer covering. The layer consists of mutually spaced short-circuiting wires, also called neutral wires, that extend longitudinally of the cable. The layer of short-circuiting wires surrounds all of the conductors. Short-circuiting wires running in parallel with each other are connected electrically together by a contact member extending helically upon the short-circuiting wires. The contact member is often formed as a metal ribbon. The purpose of the short-circuiting layer is to protect the conductors against external strains and to cause a short-circuit between the wires and the conductors if an external object, such as a spade, excavator bucket, crowbar, or other similar object penetrates through the protective covering of the cable up to the conductor for one reason or another.

An example of the prior art cable structures utilizing short-circuiting wires and a contact member formed of metal ribbon is disclosed in U.S. Pat. No. 4,360,704.

Another example of a prior art structure is described in Finnish Patent Application 911 600.

The short-circuiting layer of the cable is usually made by stranding the short-circuiting wires and the contact member connecting them by a cage-type stranding machine around the insulated conductors of the cable, after which the protective covering is formed upon the short-circuiting wires. This type of production is, however, slow and complicated. One factor contributing to the slowness of the production process is the use of ribbon as the contact member, as ribbon material is relatively difficult to handle. Another problem with ribbon material is that it is available only in limited continuous lengths, e.g. 1,500 m, which is the maximum continuous length of usable ribbon available. Still another problem is that when the contact member is made of ribbon material, the cable has a great bending stiffness and is thus relatively difficult to handle. The poor handling properties of ribbon also causes problems upon connecting the cable as the ribbon has to be exposed over a length such that the connecting point can be reached. The handling properties of ribbon material are also not the best possible in view of the connecting work itself. Moreover, ribbon material is expensive, so that its use increases the production costs.

SUMMARY OF THE INVENTION

An object of the invention is to provide a method for producing an electric cable by means of which the drawbacks of the prior art can be avoided. This is achieved by a method according to the invention, which is characterized in that the contact member is formed of a bundle of several wires. The electric cable according to the invention is characterized in that the contact member is formed of a bundle of several wires.

A major advantage of the invention is that the cable production process will be speeded up substantially as compared with the prior art technique as a bundle of wires is simple to handle as compared with ribbon material. Another advantage is that, in practice, the length of the contact member has no upper limit, as wire material is available in continuous lengths of tens of kilometres. Still another advantage of the invention is that the completed cable is considerably less stiff than a corresponding cable made by the conventional technique. Due to the increased flexibility the cable according to the invention has excellent handling properties. The cable according to the invention is also advantageous in view of the connecting step as the wires forming the contact member are easy to twist together for completing the connection, and a bundle of individual wires has much better handling properties than ribbon material. One more advantage of wire material over ribbon material is its lower price.

BRIEF DESCRIPTION OF THE DRAWINGS

In the following the invention will be described in greater detail with reference to a preferred embodiment shown in the attached drawings, in which.

DETAILED DESCRIPTION

Figure 1:
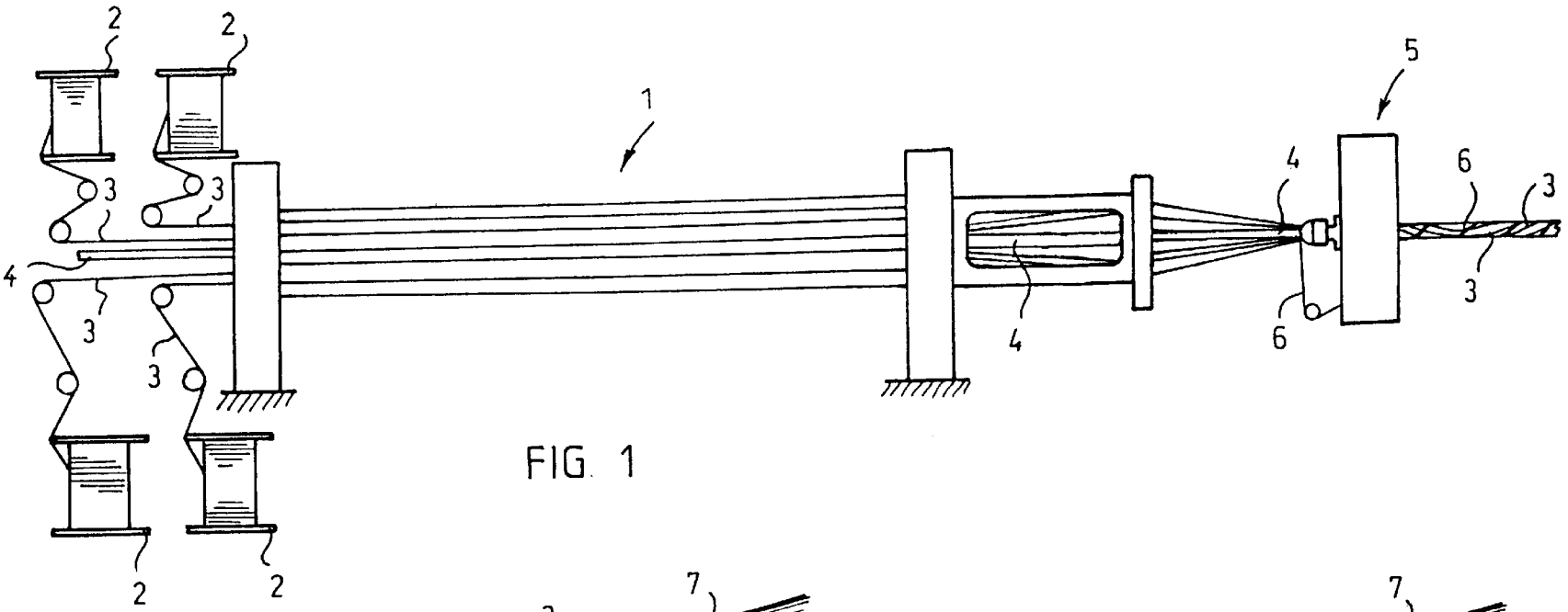
FIG. 1 is a schematic side view of one embodiment of an apparatus utilizing the method according to the invention.

FIG. 1 shows the principal features of a preferred embodiment of an apparatus utilizing the method according to the invention. Reference numeral 1 indicates generally a stranding apparatus, by means of which short-circuiting wires 3 from supply reels 2 are arranged around a central conductor portion 4 of a cable to be produced. The stranding apparatus 1 may be any apparatus allowing the short-circuiting wires 3 to be stranded around the conductor portion. The stranding apparatus 1 may be e.g. a cage-type stranding machine, a reverse stranding machine, etc. The stranding apparatus as such is not relevant to the invention, so its operation and structure will not be described more closely herein.

In FIG. 1, reference numeral 5 indicates schematically a device by means of which a contact member 6 connecting the short-circuiting wires 3 electrically is placed upon the short-circuiting wires 3. The device 5 may be e.g. a center strander. The structure and operation of the center strander are well-known to those skilled in the art, so they will not be described more fully herein, but it may suffice to state that the conductor portion 4 is arranged to run through the center of the center strander, which twists the contact member 6 around the conductor portion 4.

An essential feature of the invention is that the contact member 6 is formed of a bundle of several wires. The a separate and distinct center strander 5 thus twists a bundle of several wires around the conductor portion. The bundle may be formed e.g. of straight wires. It is also possible to use a bundle with a so-called vertical spooling torsion.

Figure 2:
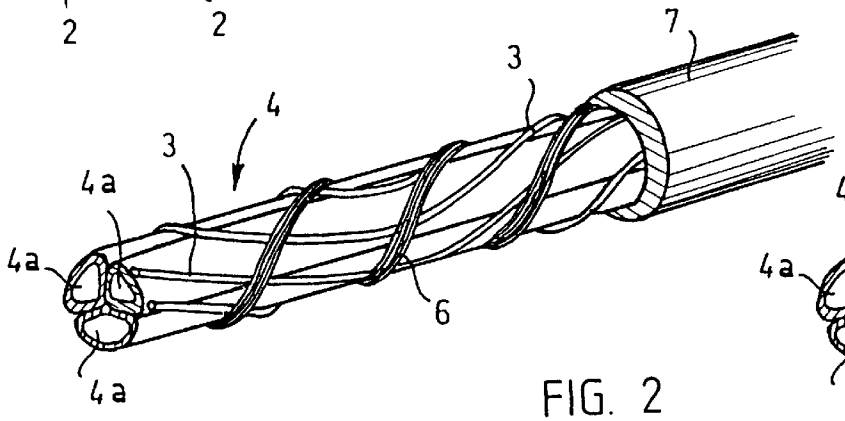
FIG. 2 is a schematic view of one embodiment of a cable produced by the method according to the invention.
Figure 3:
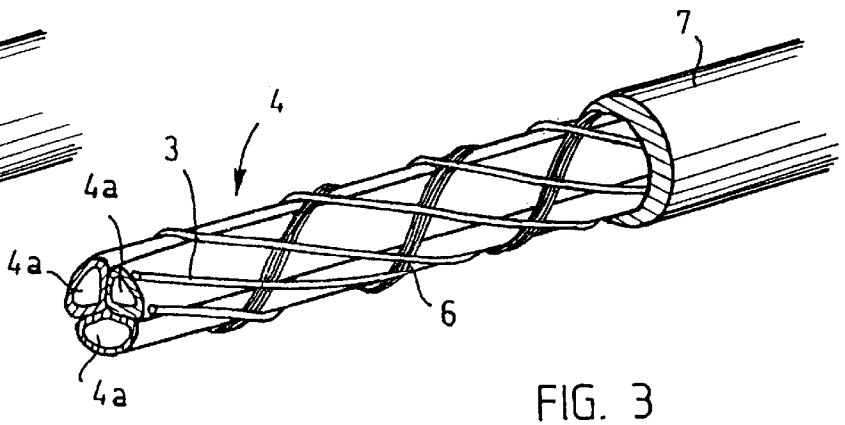
FIG. 3 is a schematic view of another embodiment of a cable produced by the method according to the invention.

The contact member 6 formed of a bundle of wires as described above appears clearly from FIGS. 2 and 3, which show two different embodiments of a cable produced by the method according to the invention. In FIGS. 2 and 3, the reference numeral 4*a* indicates insulated conductors forming the conductor portion 4. In FIGS. 2 and 3, the reference numeral 7 indicates a protective covering.

The embodiments of FIGS. 2 and 3 differ from each other regarding the short-circuiting wires 3, which are stranded in different ways. In both embodiments, the contact member 6 is formed of a bundle of wires stranded upon the short-circuiting wires 3 to form separate and distinct contact regions therewith where wires 3 and 6 cross one another. However, it is also possible that the short-circuiting wires 3 and the contact member 6 change places, i.e. places, i.e. the contact member 6 is placed under the short-circuiting wires. Except at the regions where the short circuiting wires 3 are contacted by the wires 6, the short circuiting wires 3 are electrically isolated from one another.

The embodiments described above are not intended to limit the invention in any way, but the invention can be modified within the scope of the claims as desired. Accordingly, it is obvious that e.g. the cable according to the invention or its details need not necessarily be such as shown in the figures, but other solutions are possible as well. For instance, the number of the insulated conductors may, of course, be such as required in each particular case. Similarly, it is evident that the cable may comprise different layers according to the requirements in each particular case. The protective covering may be formed in any suitable manner. The number of wires in the bundle is not limited to a certain number but it may vary in accordance with other factors affecting the design of the cable.

What is claimed is:

1. A method of producing an electric power cable comprising:

placing a short-circuiting layer between an insulated conductor and a protective covering surrounding the conductor, forming said short-circuiting layer as a plurality of separate and distinct short-circuiting wires extending substantially parallel to one another in spaced relation along said insulated conductor and a contact member positioned substantially transversely with respect to said short-circuiting wires and connecting said short-circuiting wires electrically, forming said contact member as a bundle of a plurality of individual further wires, said short circuiting wires and said plurality of individual further wires being Placed in said short circuiting layer by separately winding said short circuiting wires and said further wires on said conductor by separate stranders connected to separate supply means of said short circuiting wires and said further wires, said further wires and said short circuiting wires being respectively wound by their respective stranders such that said further wires extend helically relative to said short-circuiting wires to cause said further wires of said bundle to contact said short circuiting wires at separate and distinct contact regions around and along the cable, said short circuiting wires being electrically isolated from one another except at said contact regions with said further wires.

2. A method as claimed in claim 1, comprising utilizing a center strander as one of said separate stranders to effect the winding of said further wires of said bundle with respect to said short-circuiting wires.

3. A method as claimed in claim 2, comprising advancing said insulated conductor longitudinally through said center strander.

4. A method as claimed in claim 1, wherein said bundle of further wires is helically wound onto said short-circuiting wires after placement of the latter on said insulated conductor.

5. A method as claimed in claim 1, wherein said bundle of further wires is helically wound onto said insulated conductor whereafter said short-circuiting wires are placed on the helically wound further wires of said bundle.

6. An electric power cable comprising:

at least one insulated, longitudinally extending conductor, a protective coating surrounding said at least one insulated conductor, and a short-circuiting layer interposed between said at least one insulated conductor and said protective coating, said short-circuiting layer comprising a plurality of individual short-circuiting wires extending substantially parallel to one another, in spaced relation along said at least one insulated conductor and a contact member positioned substantially transversely with respect to said short-circuiting wires and connecting said short-circuiting wires electrically, said contact member being constituted as a bundle of a plurality of individual further wires helically wound relative to said short-circuiting wires and in contact with said short circuiting wires at separate and distinct contact regions along the cable, said short circuiting wires being electrically isolated from one another except at said contact regions with said further wires.

7. An electric cable as claimed in claim 6, wherein said further wires in said bundle are separate and distinct from one another.

8. An electric cable as claimed in claim 7, wherein said bundle of further wires is helically wound on said short-circuiting wires which are on said at least one insulated conductor.

9. An electric cable as claimed in claim 7, wherein said bundle of further wires is helically wound on said at least one insulated conductor, said short-circuiting wires being on said bundle of further wires.

* * * * *